United States Patent [19]

Yensen

[11] 4,041,660

[45] Aug. 16, 1977

[54] SELF-ALIGNING BLOCKS

[76] Inventor: William A. Yensen, 5419 Central Ave., Bonita, Calif. 92002

[21] Appl. No.: 653,436

[22] Filed: Jan. 29, 1976

[51] Int. Cl.[2] ..... E04C 1/12; E04C 1/30

[52] U.S. Cl. ..... 52/100; 52/284; 52/590; 52/594; 52/606

[58] Field of Search ..... 52/280, 286, 98-100, 52/589-594, 606

[56] References Cited

U.S. PATENT DOCUMENTS

| | | | |
|---|---|---|---|
| 747,495 | 12/1903 | Soss | 52/284 |
| 903,907 | 11/1908 | Soss | 52/594 |
| 3,435,576 | 4/1969 | Giannelia | 52/594 |
| 3,462,062 | 8/1969 | Miller | 52/594 |

FOREIGN PATENT DOCUMENTS

| | | | |
|---|---|---|---|
| 1,083,300 | 9/1967 | United Kingdom | 52/590 |

*Primary Examiner*—James L. Ridgill, Jr.
*Attorney, Agent, or Firm*—Ralph S. Branscomb

[57] ABSTRACT

A self-aligning construction block consisting of a basic double block having two flat vertical sides connected by two flat vertical end surfaces, the sides being twice the length of the ends with compound angled top and bottom surfaces having two hollowed center portions for receiving a reinforcing cement fill. The top and bottom surfaces of the basic blocks complement each other for automatic stacking. In construction of a wall, the top surface of modified top blocks and the bottom surfaces of modified bottom blocks are flat and at right angles to the side and end surfaces. The angular relationships of the basic block's top and bottom surfaces perforated by two hollow wells allow for reinforcement rods to lie in a transverse axis and at right angles thereto across each hollow well in a substantially coplanar relationship. Any odd space at the end of a wall is taken up by a half block which is constructed exactly as one half of the basic double block. Similar half blocks of special top and bottom configuration fill odd spaces at the ends of the top and bottom block courses.

4 Claims, 14 Drawing Figures

SELF-ALIGNING BLOCKS

PRIOR ART

A typical prior art interlocking and self-aligning building block is disclosed by U.S. Pat. No. 3,435,576 to Gianelli, issued Apr. 1, 1969. In the Gianelli block, a top longitudinal central ridge is shown which, together with the general angular geometric configuration of the block, precludes the conventional use of reinforcement rods lying adjacent to the same horizontal plane which, of course, limits the application of the block itself to one of a more decorative utility. This is further evidenced by the fact that it is basically designed as a groutless assembly.

BRIEF DESCRIPTION OF THE INVENTION

According to the invention, a self-aligning structural block assembly is provided which utilizes a basic block having complementary top and bottom surfaces because of angulated geometry thereon. The two vertical side surfaces and end surfaces are at right angles to each other and are flat in structure for utilization in the construction of a wall, for example. Modified top and bottom blocks of a given structure have flat top and bottom surfaces, repectively, with the basic geometrically angled surfaces opposite the flat surfaces for cooperation with the next vertically adjacent blocks. The basic block has a length twice its width with first and second hollow wells extending therethrough separated by a central section. On one of the top or bottom surfaces, preferably the top, the center section has a ridge which cooperates with an effective recess on the bottom surfaces at the juncture of the two blocks lying above it. Slots are cut in the central portion of the block at its transverse axis which due to the unique construction of the block would accommodate a linear reinforcement rod extending transversly along the long center of the block and with minor "knock-out" of a thin wall, from one block to the next. Slots are also cut in the side portions of the blocks for the receiving of reinforcements rods at right angles to the transverse reinforcement rods and adjacent to the same horizontal plane to allow for tying. The voids at the end of any one structure are filled by half blocks which are exactly the same as the fundamental building block of the present invention but cut in half at the central ridge/recess plane. This is necessary because the basic blocks are staggered as is normal in the masonary art. It has been found empirically that the consistent utilization of 63.3° and 26.7° angles at the planar intersections with the flat sides and ends results in a simple two to one grade which is extremely pleasing aesthetically. The edges are preferably beveled also for aesthetic purposes.

An object of the present invention is the provision of a self-aligning block assembly which can utilize conventional block assembly.

Another object of the invention is the provision of a self-aligning block assembly which can utilize conventional reinforcing elements and techniques.

A further object of the invention is the provision of a self-aligning block assembly which is self-complementing.

Yet another object of the invention is the provision of a self-aligning block assembly having an extremely simple geometry.

A still further object of the invention is the provision of a self-aligning block assembly which is simple to assemble and extremely pleasing aesthetically.

Other objects and many of the attendant advantages of the present invention will be readily appreciated as the same becomes better understood by reference to the following detailed description when considered in connection with the accompanying drawings in which like reference numerals designate like parts throughout the Figures thereof and wherein.

DETAILED DESCRIPTION OF THE DRAWING

Figure 1:
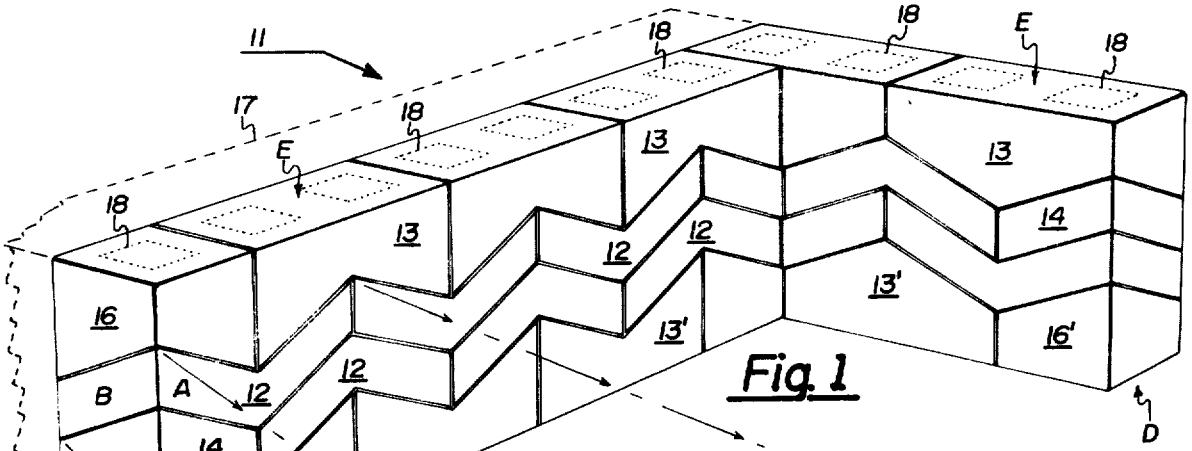
FIG. 1 is a perspective view of the preferred block assembly of the present invention.

Referring to FIG. 1, a wall assembly 11 is shown consisting of a plurality of basic blocks 12 with modified blocks 13 and 13' forming the top and bottom layers therein. Basic half blocks 14 are utilized at the end portions thereof with modified half blocks 16 and 16'' utilized in end portions at the top and bottom layers. A second double-bonded layer 17 of wall assembly 11 is shown in phantom. Cement filled ports 18 are shown on the top surface of wall assembly 11. Sides and ends of basic blocks 12 are indicated at A and B. The bottom of modified blocks 13' and 16' are indicated at C and D, respectively. The top surface is E.

Figure 2:
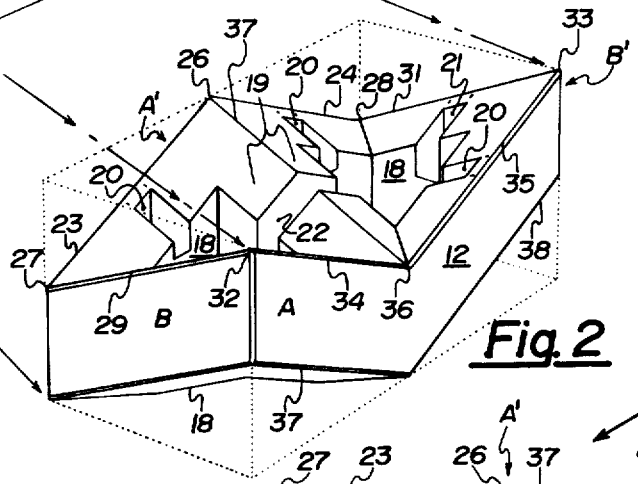
FIG. 2 is a perspective view of a basic block of the present invention.
Figure 3:
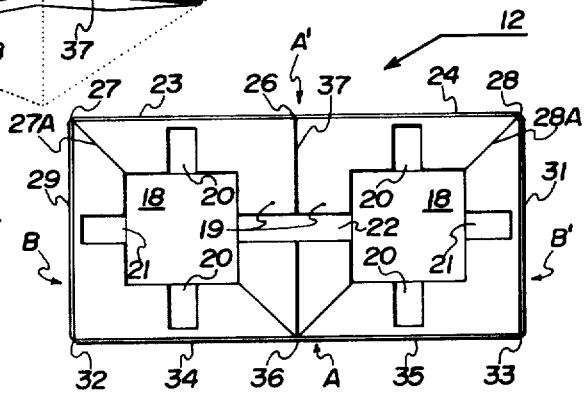
FIG. 3 is a top plan view of the block of FIG. 2.

Referring to FIGS. 2 and 3, a basic building block 12 is shown with near and far flat side faces indicated at A and A'. Near and far flat end faces indicated as B and B' are at right angles to side faces A. A center section 19 divides hollow ports 18 in block 12. Later reinforcement rod notches 20 lie on opposite sides of hollow ports 18. Transverse reinforcement rod notches 21 adjacent the B faces cooperate with transverse reinforcement rod notch 22 in center section 19. Planar slopes 23 and 24 drop from a high central point 26 on the far side A' to low corner points 27 and 28, respectively, on the same side. Planar slopes 34 and 35 drop from high corner points 32 and 33 on the near side A to a central low point 36 on the same side and are bounded by edge lines 29 and 31. Central sloping ridge 37 drops from high point 26 to low point 36 and bounds both planar slopes 23 and 24. Planar slopes 37 and 38 are parallel with slopes 34 and 35, respectively.

Figure 4:
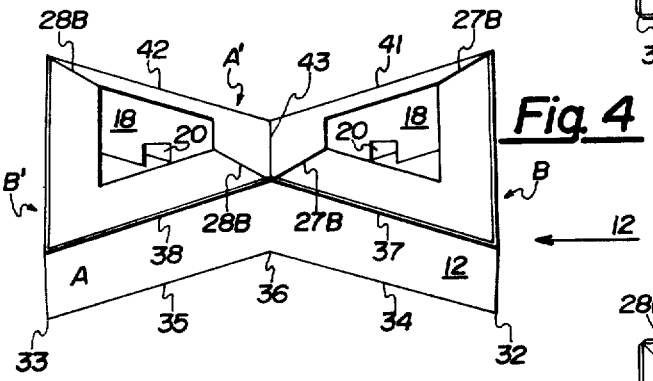
FIG. 4 is a forward tilted perspective view of the bottom portion of the block of FIG. 2.
Figure 5:
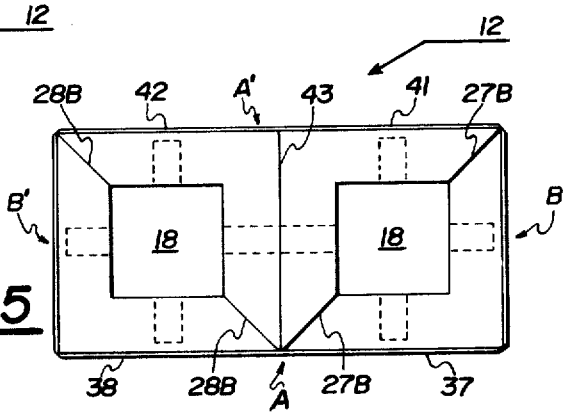
FIG. 5 is a bottom plan view of the block of FIG. 2.

Referring to FIG. 4, where the basic block 14 of FIG. 2 has been rotated 180° around a short central axis and also to FIG. 5, it can be seen that slopes 23 and 24 are parallel to slopes 41 and 42, respectively. Sloping ridge recess 43 in center section 19 is parallel with ridges 37. In practical use, this "upward-pointing-chevron" orientation would be achieved by rotating basic block 14 of FIG. 2 around a vertical axis 180° to retain the reinforcing rod notches 20, 21 and 21A on the upper surface.

Figure 6:
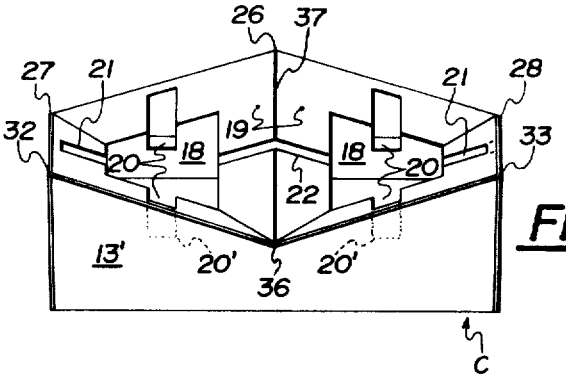
FIG. 6 is a forward tilted perspective view of a modified bottom block utilized in FIG. 1.

Referring to FIG. 6, a special bottom block 16' is shown wherein a top portion is identical to the block of FIGS. 2 and 3 and the numbering is identical. Optional thin-walled knock-out zones are indicated at 20'. The sole difference between the modified bottom block 16' of FIG. 6 and the basic block 12 of FIG. 2 is bottom surface C which is flat as shown by reference to FIG. 1.

Figure 7:
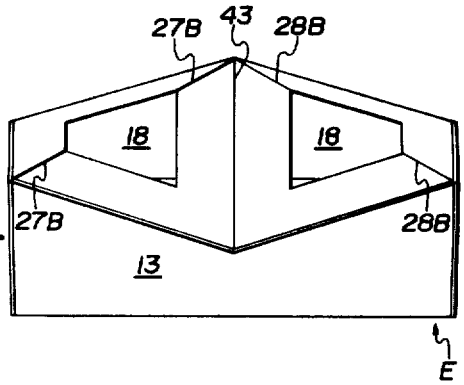
FIG. 7 is a forward tilted perspective view of a special top block, inverted.

Referring to FIG. 7, a special top block 13 is shown inverted wherein the exposed bottom surface is topologically identical to the bottom of basic block 12 as viewed in FIGS. 4 and 5, although the special top block 13 has here been rotated 180° around a vertical axis for best viewing. Numbers are identical for the identical features and the flat top of the inverted block is indicated at E.

Figure 8:
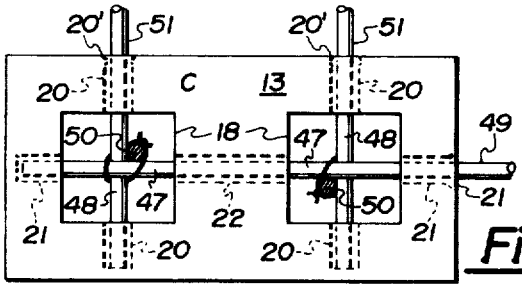
FIG. 8 is a bottom plan view of the block of FIG. 6.

FIG. 8 illustrates the bottom surface C of special bottom block 13' of FIG. 6 wherein the optional knock-out zones 20' have been knocked out at two of the lateral reinforcement rod notches 20 and an optional knock-out zone 21' has been knocked out adjacent to the transverse reinforcement rod notch 21. A reinforcement rod 47 is located within transverse recesses 21 and 22 with the end of one of said recesses knocked out 21' and an end 49 of reinforcement rod 47 protruding from block 13' for the purpose of continuing said reinforcement through other blocks in the same course. Reinforcement rods 48 are located within lateral recesses 20 of block 13' with one end 51 extending therefrom through knock-out areas 20' for the purpose of double-bonding reinforcement. Reinforcement rods 47 and 48 are shown tied together with vertical reinforcement rods 50 at their intersections within hollow ports 18.

Figure 12:
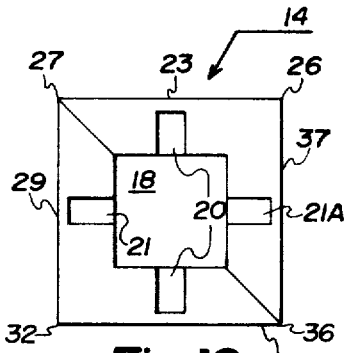
FIG. 12 is a top plan view of the half block of FIG. 9.
Figure 9:
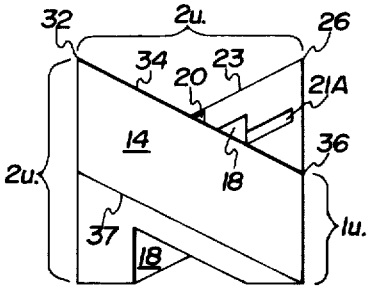
FIG. 9 is a side elevation view of a basic half block utilized in the present invention.

Referring to FIGS. 9 and 12, a basic half block is shown generally at 14 having planar slopes 23 and 37 corresponding in this rotational orientation to slopes at the left side of bilaterally symmetrical block 12 of FIGS. 2 and 3 and with a similar hollow port 18. Reinforcement rod notches 20 and 21 correspond in location with those at the left of FIGS. 2 and 3 with notch 21A representing a segment of notch 22 adjacent to central sloping ridge 37 of block 12. High points 26 and 32 and low points 27 and 36 are identical in function and are identically numbered. FIG. 9 is also identical in apperance with end B' of basic block 12, FIGS. 2 and 3.

Figure 13:
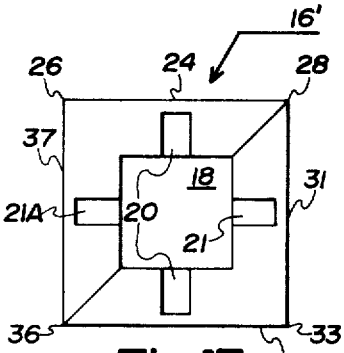
FIG. 13 is a top plan view of the half block of FIG. 10.
Figure 10:
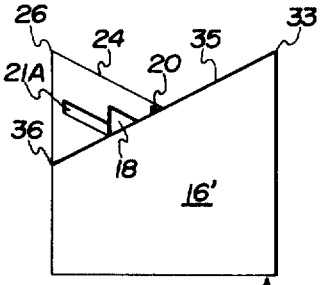
FIG. 10 is a side elevation view of a special bottom half block.

FIGS. 10 and 13 illustrate a modified bottom half block with a flat base D and an upper surface corresponding in this rotational orientation to features at the right side of bilaterally symmetrical block 12 of FIGS. 2 and 3 and said features are similarly numbered.

Figure 14:
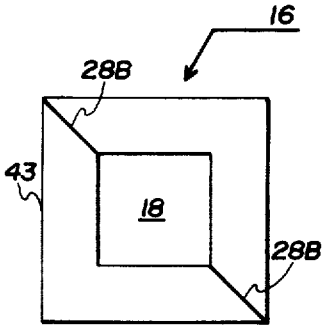
FIG. 14 is a top plan view of the half block of FIG. 11.
Figure 11:
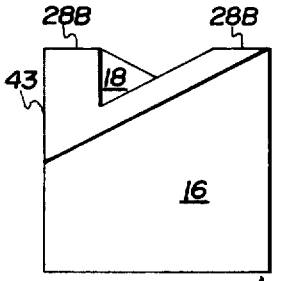
FIG. 11 is a side elevation view of a special top half block inverted.

Referring to FIGS. 11 and 14, a special top half block 16 is shown inverted whenin the exposed bottom surface is topologically identical to the right side of inverted modified block 13 of FIG. 7, and is identically numbered. The flat top of the inverted half block 16 is indicated at E. None of the top blocks 13 or 16 are provided with reinforcement rod recesses, i.e., 20, 21 and 22 of FIG. 6; these are near the top mating surfaces of the blocks immediately under the top blocks 13 and 16.

Referring back to FIG. 1, it can be seen that all of the major exposed surfaces of blocks 12, 13, 13' 14, 16 and 16' are flat and with their edges beveled form an aesthetically pleasing masonry structure design. In construction, after the various blocks are grouted up to form a wall, such as that shown in FIG. 1, and after desired reinforcement rods are in place, cement is poured down hollow ports 18 at the top of the structure to insure structural integrity.

Referring back to FIGS. 2 and 4, it can be seen that planar slope 23 including the left face of center portion 19 starting at ridge 37 forms one facet which is cut at a one to two slope, or 26.7° angle where it meets the vertical back surface A' and is parallel to bottom planar slope 41. Planar slope 34 forms another facet cut at a one to two slope or 26.7° angle as viewed at the vertical side A and also at vertical end B, and is parallel to bottom planar slope 37.

Planar slope 24, including the center portion 19 to the right of ridge 37 forms a similarly angled third facet which is parallel to bottom planar slope 42. Planar slope 35 is a fourth facet with similar angular attributes and is parallel to bottom planar slope 38.

Referring back to FIG. 4, the facets formed by slopes 37, 38, 41 and 42 create facets which complement the slopes or the facets of FIG. 2. Hence, when one block 12 is placed on top of another block 12, the slopes create facets which are totally complementary and it is not possible to slide or rotate one block relative to the other without lifting it. The same holds true with the facets created by the various slopes of blocks 13, 13', 14, 16 and 16'. Reinforcement recesses 20, 21 and 22 are intentionally molded short of their respective adjacent sides or ends. This thin walled portion may be knocked out to allow a through passage. When these edges form an outside surface, they are, of course, left intact for aesthetic reasons. Hence, in FIG. 8, or example, the left and lower surfaces are intended to represent outside surfaces and the reinforcement rod recesses are not knocked through since the reinforcement rod does not extend therefrom. This block would represent, for example, the bottom left and block of FIG. 1 if double bonding were desired in front of the wall instead of in back as indicated at 17. Because of the angulation and geometry of the various facets of blocks 12, 13, 13', 14, 16 and 16', a slope of two to one creates a pleasing assembly with a subtle pattern variation at every corner. Since basic half block 14 of FIG. 8 is exactly one half of basic block 12, it can be formed by cutting block 12 on a vertical plane which passes through ridge 37 and ridge recess 43 without disturbing the basic angles. Similar half cuts of bottom block 13' and top block 13 create special half blocks 16' and 16, respectively.

It should be understood, of course, that the foregoing disclosure relates to only a preferred embodiment of the invention, and that it is intended to cover all changes and modifications of the example of the invention herein chosen, for the purposes of the disclosure, which do not constitute departures from the spirit and scope of the invention.

The invention claimed is:

1. A self-aligning construction block comprising:

a basic block having two flat vertical sides connected by two flat vertical end surfaces;

a top surface and a bottom surface, at least one of said top surface and bottom surface being a compound angled surface consisting of first, second, third, and fourth facets, said first and second facets having high points at two top corners of one of said two flat vertical sides, and low points at the top center of said one of two flat vertical sides, and two low points at the top corners of the other of said two flat vertical sides;

said third and fourth facets having a high point at the top center of said other of two said flat vertical sides and a low point at the top center of said one of said two flat vertical sides, and low points at the top two corners of said another of said flat vertical sides; and first and second hollow wells extending from said top surface through said bottom surface to define a central divider section therebetween;

said divider section having a slot entrant therein from one of said surfaces and aligned essentially parallel to said sides to receive a portion of a steel reinforcing rod.

2. Structure according to claim 1 and including a plurality of cut-away portions approaching portions of the exterior surface of said block from the interior but leaving the exterior surface intact and continuous to define optional knock-out portions to accomodate horizontal reinforcing rods or to retain a continuous surface if horizontal reinforcing rods are not used.

3. Structure according to claim 2 wherein two of said knock-out portions are defined adjacent said flat vertical end surfaces respectively in alignment with the slot in said divider section such that a longitudinally extended horizontal reinforcing rod might be accomodated through all or a portion of said block.

4. Structure according to claim 3 and further including knock-out portions defined in the sides of said block by cut-aways extending laterally outwardly from both sides of each of said wells to define two potential lateral reinforcing rod corridors in addition to the longitudinal corridor defined in part by said slot and the vertical passageways defined by said wells, such that optionally reinforcing rods can be used in any or all of the three dimensions, but all exposed vertical surfaces of a construction of blocks can be retained continuous.

* * * * *